US008001887B2

(12) United States Patent
Harari

(10) Patent No.: US 8,001,887 B2
(45) Date of Patent: Aug. 23, 2011

(54) UNIVERSAL MANUAL TRASH COMPACTOR

(76) Inventor: Abraham Harari, Chatsworth, CA (US)

( * ) Notice: Subject to any disclaimer, the term of this patent is extended or adjusted under 35 U.S.C. 154(b) by 203 days.

(21) Appl. No.: 12/317,499

(22) Filed: Dec. 24, 2008

(65) Prior Publication Data

US 2010/0154663 A1 Jun. 24, 2010

(51) Int. Cl.
*B30B 1/04* (2006.01)
*B30B 15/04* (2006.01)

(52) U.S. Cl. ..... 100/229 A; 100/233; 100/265; 100/293; 100/295

(58) Field of Classification Search ..... 100/214, 100/226, 229 A, 233, 265, 292, 293, 295
See application file for complete search history.

(56) References Cited

U.S. PATENT DOCUMENTS

| | | | | | |
|---|---|---|---|---|---|
| 1,294,211 | A | | 2/1919 | Webley | |
| 2,465,839 | A | | 5/1945 | Bloomfield | |
| 2,423,209 | A | * | 7/1947 | Storey | 100/245 |
| 3,760,718 | A | * | 9/1973 | Adornetto | 100/227 |
| 3,779,157 | A | | 12/1973 | Ross, Jr. et al. | 100/240 |
| 3,919,932 | A | * | 11/1975 | Basuino | 100/228 |
| 3,929,060 | A | | 12/1975 | Burke | 100/100 |
| 3,986,447 | A | * | 10/1976 | Zimmer | 100/219 |
| 4,050,373 | A | | 9/1977 | Hellmann | 100/240 |
| 4,128,055 | A | | 12/1978 | Hellmann | 100/245 |
| 4,286,515 | A | | 9/1981 | Baumann et al. | 100/233 |
| 4,331,074 | A | | 5/1982 | Behman | 100/215 |
| 4,649,813 | A | | 3/1987 | Kehl | 100/227 |
| 4,658,720 | A | | 4/1987 | Massonnet | 100/226 |
| 4,854,497 | A | | 8/1989 | Smith | 232/43.4 |
| 4,991,500 | A | | 2/1991 | Knapp | 100/90 |
| 5,042,374 | A | | 8/1991 | Klepacki | 100/229 |
| 5,090,309 | A | | 2/1992 | Lai | 100/226 |
| 5,115,736 | A | | 5/1992 | Rodolico et al. | 100/90 |
| 5,730,047 | A | | 3/1998 | Lindsey | 100/90 |
| 5,845,567 | A | | 12/1998 | Fischer | 100/226 |
| 6,314,874 | B1 | | 11/2001 | Martorella | 100/226 |
| 6,851,357 | B1 | | 2/2005 | Martorella et al. | 100/226 |
| 6,889,604 | B2 | * | 5/2005 | Ernst | 100/226 |
| 7,010,840 | B2 | * | 3/2006 | Reale | 29/263 |
| 7,490,545 | B2 | * | 2/2009 | Baghdoian | 100/226 |
| 2003/0024419 | A1 | | 2/2003 | Ernst | 100/229 |

* cited by examiner

*Primary Examiner* — Jimmy T Nguyen
(74) *Attorney, Agent, or Firm* — Clifford Kraft

(57) ABSTRACT

A safe, inexpensive, easy to use, manual trash compactor that can be used with almost any trash container with components that store out of the way when not in use. A hand or foot control is easily manipulated to compact trash in the container. The compacting mechanism can be made easily adjustable so that the amount of force or the size of the unit can be changed for different operators or different trash containers. The unit can be used with no container to compact materials like cardboard. The compactor can have wheels and can optionally be operated by a foot lever.

12 Claims, 11 Drawing Sheets

UNIVERSAL MANUAL TRASH COMPACTOR

BACKGROUND

1. Field of the Invention

The present invention relates generally to the field of trash compactors and more particularly to a universal manual trash compactor that can accommodate any type of trash receptacle. The manually operated trash compactor promotes safety when disposing of trash and precludes the need to compress trash inside a receptacle.

2. Description of the Prior Art

There are many trash compactors known in the art that operate using mechanical assistance with motors, screws, hydraulics and the like. Most of these require attachment to an electrical outlet with consequent energy consumption and the risk of mechanical or electrical failure as well as a danger to the operator from a mechanized compactor. There are also manually operated compactors known in the art.

Martorella in U.S. Pat. No. 6,314,874 teaches a manual trash compactor for use with garbage with an adjustable arm and stabilizing blocks. This device is for use with a garbage can having an open tope and a closed bottom.

Adornetto in U.S. Pat. No. 3,760,718 teaches a trash compactor for attachment to containers such as a trash or garbage can.

Lindsey in U.S. Pat. No. 5,730,047 teaches a portable refuse compacting container including a container for receiving a flexible refuse collection bag.

Webley in U.S. Pat. No. 1,294,211 teaches a press adapted for use in connection with a cylindrical recepticle.

Klepacki in U.S. Pat. No. 5,042,374 teaches a manual trash compactor for compacting trash in a trash receptacle enclosed in a housing.

Knapp in U.S. Pat. No. 4,991,500 teaches a refuse compactor device for use with a trash bag.

Brauman et al. in U.S. Pat. No. 4,286,515 teach a compacting waste basket.

None of the prior art units are self-contained and portable, free-standing and operating from any flat surface, and allow compacting in a variety of different sized trash containers. It would be advantageous to have a safe, manual trash compactor that included a simple frame with a protective cover that would accept many different size trash containers and could be adjustable for size and/or force.

SUMMARY OF THE INVENTION

The present invention relates to an inexpensive, easy to use, free-standing manual trash compactor that operates on any flat surface and can be used with almost any trash container. A hand or foot control can be easily manipulated for compacting the trash in the container. The compacting mechanism can be made so that is safe, efficient, promotes recycling and is easily adjustable so that the amount of force or the size of the unit can be changed for different operators or different trash containers. The compactor of the present invention is safe and will not cause serious injury when used. The unit can be used with no container to compact materials like cardboard. The present invention can have wheels and can be optionally operated with a foot lever. The manually operated trash compactor of the present invention promotes safety when disposing of trash by precluding the need to compress trash inside a receptacle by putting ones hand or foot inside a trash can for the purpose of creating more space. The device promotes recycling The unique delivery system of the present invention provides for penetrating any shape of container or receptacle (or used with no receptacle). The unit can be adjusted to accommodate different sized receptacles. The unit can also compress cardboard boxes or other items without a receptacle.

The unit is free standing, and a trash can can stay parked in the unit until full to the maximum. Then another trash can can be rolled into the space. The trash can's lid can be swung open while the trash can is still in place. Particular embodiments of the invention can be free standing, while other embodiments can be bolted, or otherwise attached, to on exterior wall. The function is the same in each case, the handle is pulled down to compress the contents. The present invention is a first of kind that functions with no need for attaching the unit to a trash can. The trash can is simply wheeled into place and then wheeled out again when compressed.

DESCRIPTION OF THE FIGURES

Attention is directed to several illustrations to better understand the present invention.

Several illustrations and drawings have been presented to aid in understanding the present invention. The scope of the present invention is not limited to what is shown in the figures.

DESCRIPTION OF THE INVENTION

The present invention relates to a new, inexpensive, efficient manual trash compactor that can be used universally with any trash or recycling container or with no container at all. Since, the device can be used with any normal container, it encourages recycling by compacting the contents of recycling bins providing more space.

Figure 1:
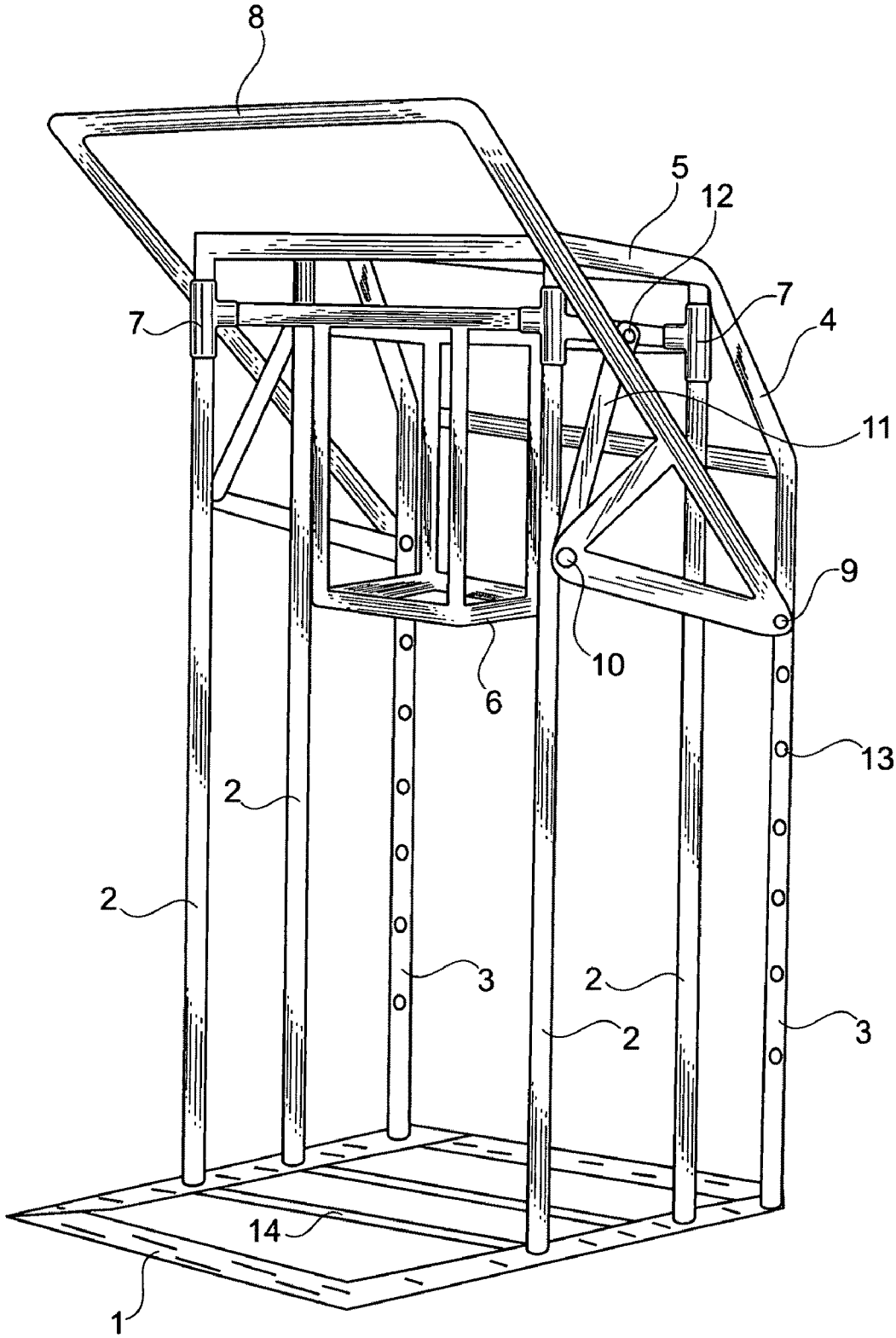
FIG. 1 shows a perspective view of the frame of an embodiment of the trash compactor.
Figure 2:
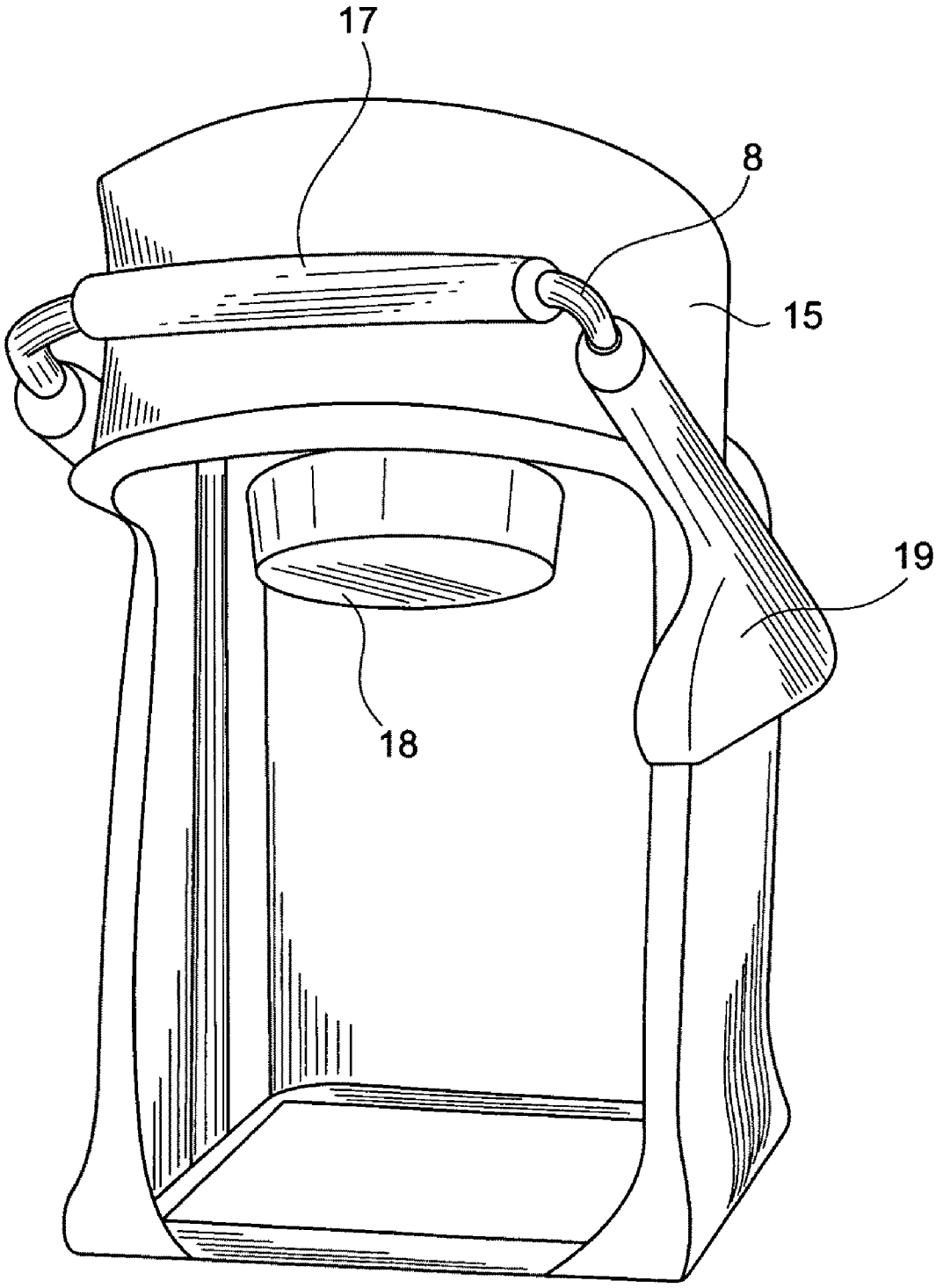
FIG. 2 shows a conceptual drawing of an embodiment of the present invention with an outer cover forming a compacting station.

Turning to FIG. 1, a perspective view can be seen of the internal frame of an embodiment of the compactor. FIG. 2 shows a conceptual view of what the frame of FIG. 1 might look like with an outer cover or protective utility shell.

In FIG. 1, a flat base attaches to a rear support frame 3 and a set of vertical slider supports or slider members 2. The slider supports 2 can be made of metal or any other hard material such as one of many types of hard polymer. The frame can also be metal or polymer. The slider supports 2 can be round pipe, rectangular or any other shape. A set of sliders 7 are free to slide up and down on the support sliders 2. The slider supports 2 are held together by a top frame 5 and optionally slanting upper back frame 4. A compactor driver 6 is attached to the sliders 7 through a framework of supports. While the compactor driver 6 in FIG. 1 is shown to be a rectangular box, any shape is within the scope of the present invention including a solid piece. A handle 8 is attached to a pivot 9 on the rear frame 3. The point 9 can be moved up and down to various positions located at holes 13 using removable pins, snap locks and the like. Moving the handle 8 up and down also causes the compactor driver 6 to move up and down. This allows the device to adjust vertically to any size container (or to compact with no container such as might be done to compact cardboard boxes). The handle 8 is attached to a drive rod or bar 11 at a lower pivot 10. The drive rod 11 is attached to the compactor driver assembly 6 at an upper pivot 12.

As previously stated, FIG. 2 shows a conceptual view of an embodiment of the present invention in a stylized utility cover 15. The handle 8 can have a handle guard or cover 17 which can be a material like hard or soft rubber, or it can be plastic. The handle sides are covered with a side guard 19. It can be seen that due to the open front, it is easy to slide or wheel any type of container into the opening. The compactor head 18 descends when the handle 8,17 is lowered. Optionally, the compactor mechanism can be operated by a foot lever. The compactor head 18 can be metal, hard rubber, hard plastic or any strong material. It should be noted that the compactor head 18 can be optionally interchangeable with a choice of different sized or shaped heads for different tasks.

Figure 3:
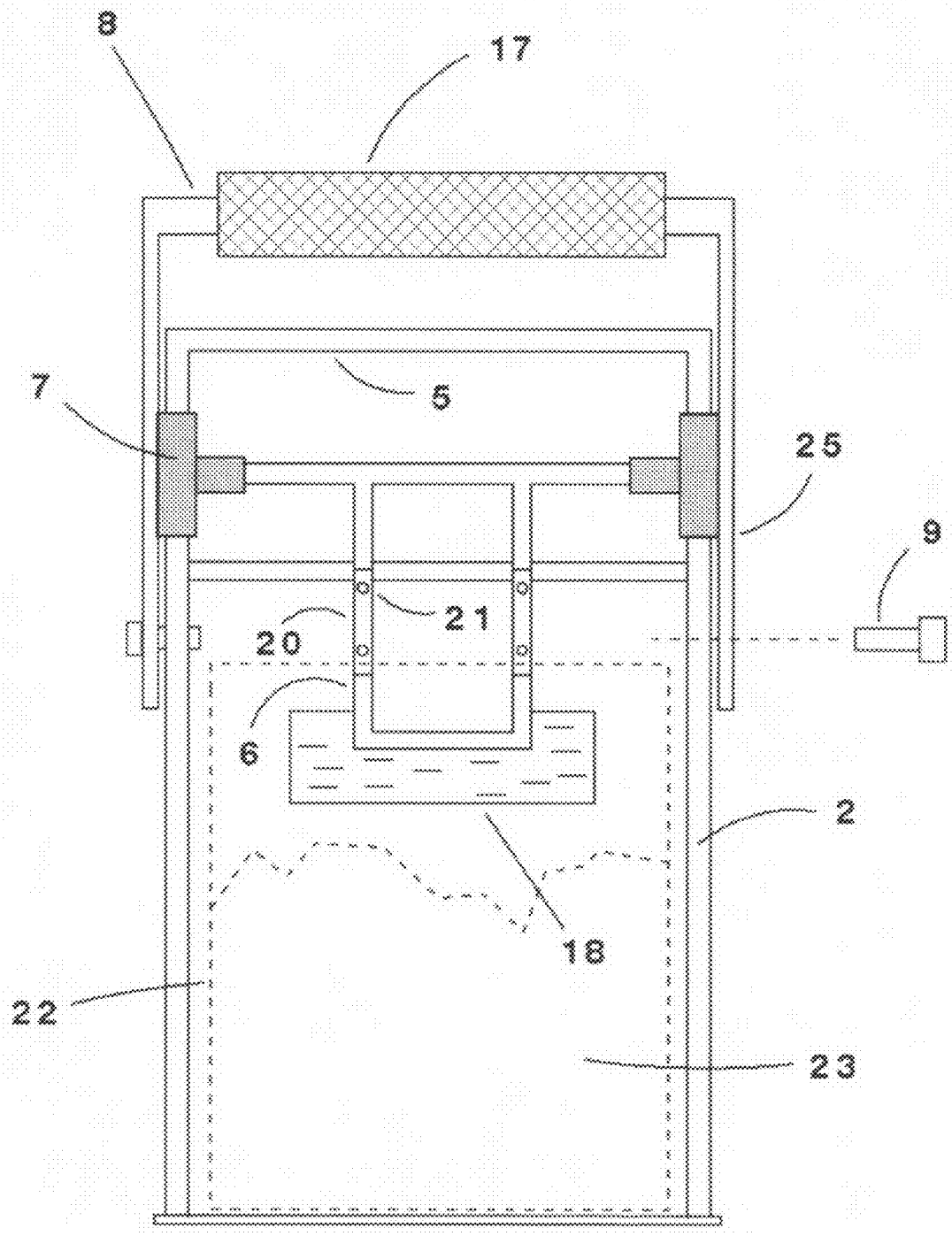
FIG. 3 shows a front view of part of the frame of FIG. 1.

Turning to FIG. 3, a front view of the frame from FIG. 1 can be seen. The handle 8 is covered with a cover 17. The vertical slider supports 2 allow the tubular sleeves or sliders 7 to move up and down when the handle 8 is pulled or pushed downward. The compactor driver 6 pushes the compactor head 18 down into the container 22 (if a container is being used) and compacts the trash or recycled materials 23. A set of removable side pins or clips 9 fit into the frame at different selectable vertical positions 25 to allow up and down adjustment of the compactor head 18 for different sized containers 22.

Figure 4:
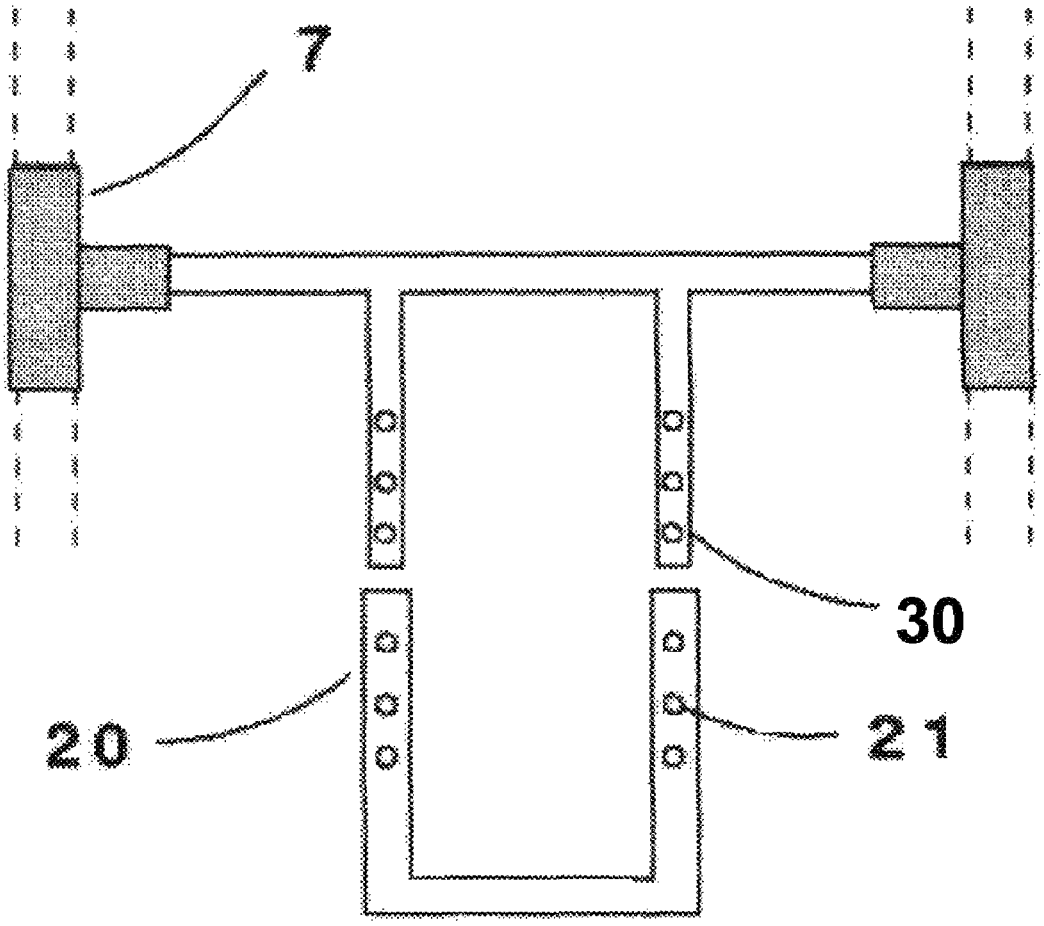
FIG. 4 shows a detail of an embodiment of an adjustable compaction part.

Also seen in FIG. 3 is an embodiment of the invention from that of FIG. 1 in that the compactor driver 6 is adjustable to different lengths using a telescoping tube 20 with adjustment pins or clips 21. This can be seen better in FIG. 4 where the telescoping tube 20, pins 21 and holes 30 can be seen.

Figure 5:
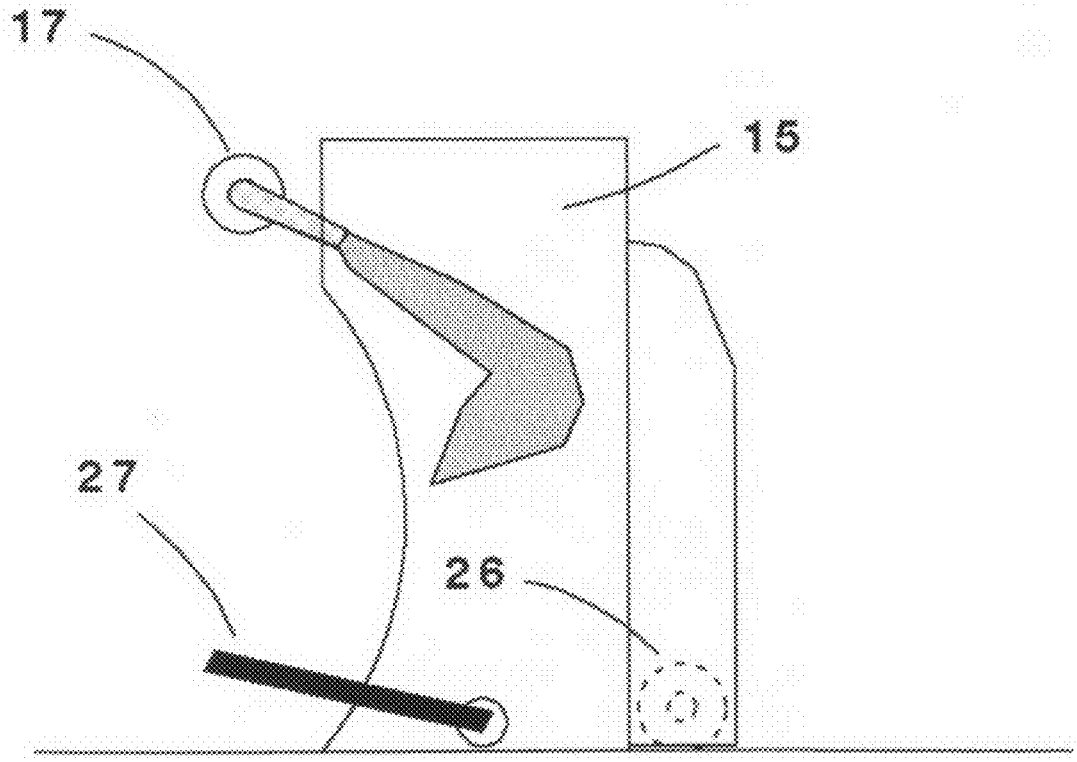
FIG. 5 shows a side view of an embodiment with a foot pedal.

FIG. 5 shows a side view of an embodiment of the present invention. In addition a set of rear wheels 26 is seen. It is entirely optional whether wheels are used or not. The present invention can be used on any flat surface. The present invention can typically be made of fairly light material such as hard plastic or light metal so that it becomes an ideal side yard universal trash unit. FIG. 5 also shows an optional foot lever 27 that can operate the compactor instead of the handle 8, 17.

Figure 6:
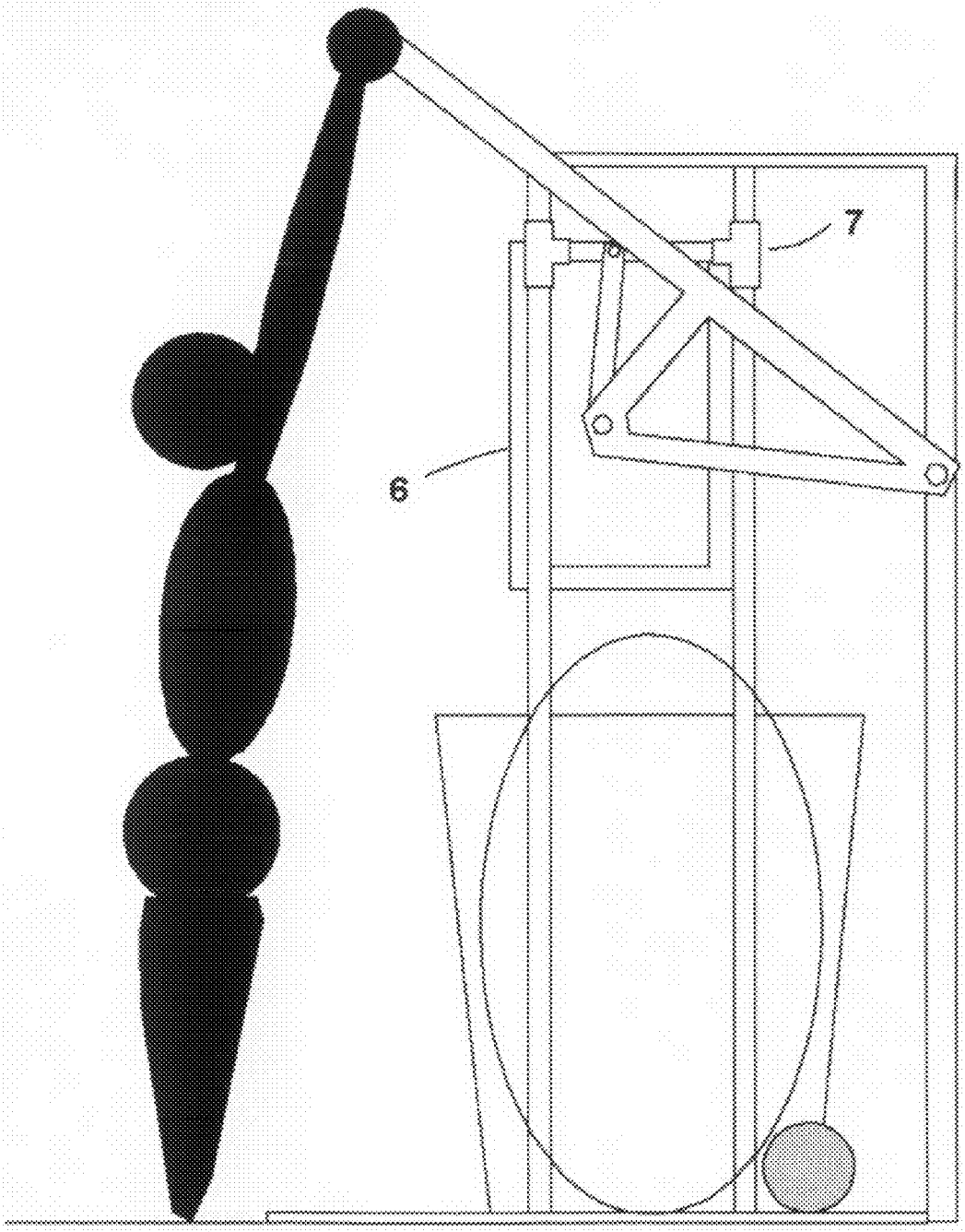
FIG. 6 shows a side schematic view of a unit in a full upper or loading position.
Figure 7:
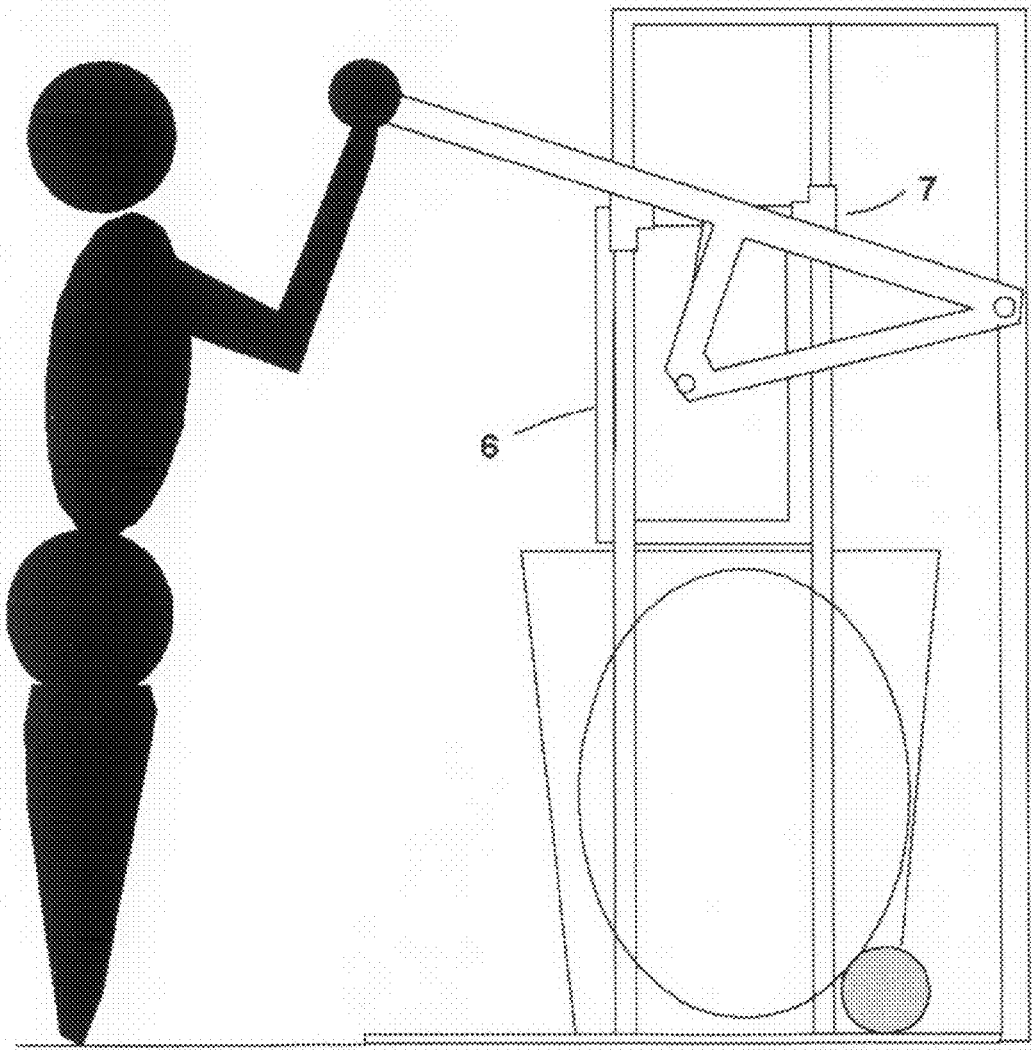
FIG. 7 shows a side schematic view of the unit of FIG. 6 in a half-way position
Figure 8:
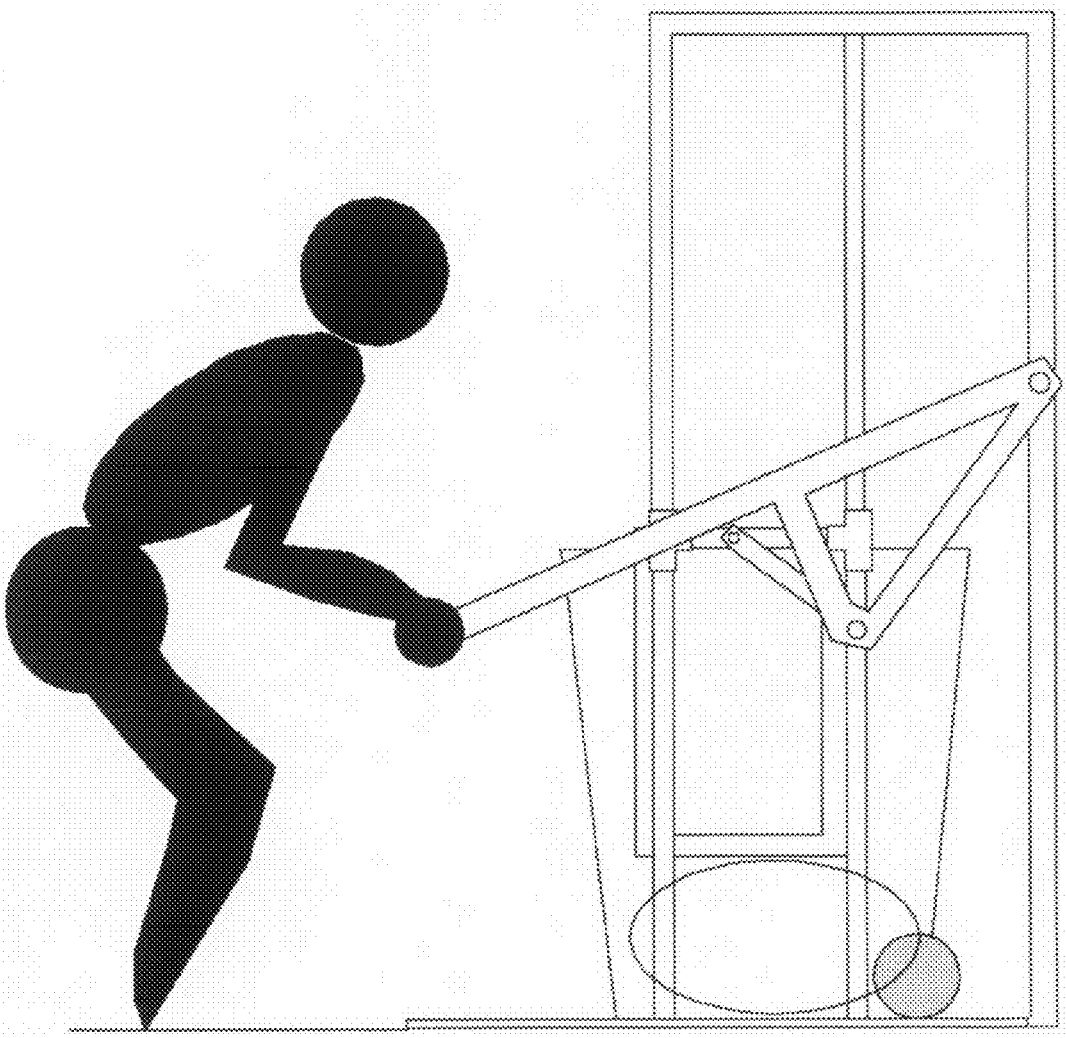
FIG. 8 shows a side schematic view of the unit of FIG. 6 in a full down compressing position.

FIGS. 6-8 show how the present invention can be used. A trash container can be wheeled into, or otherwise placed into the invention with the lever arm vertically set to a correct height. FIG. 6 shows the lever arm set high to accommodate a large trash receptacle. With the trash container (or trash like cardboard with no container) in place as in FIG. 6, the lever arm can be lowered as shown in FIGS. 7-8 to compact the trash. FIGS. 6-8 shows an example of the unique way that compression energy is delivered down the tubular frame of the device to drive the plunger 6 and compression head (not shown). In brief, the cover of a trash container is removed or flipped open, and then the container is maneuvered into position under a compactor head attached to the lever arm. In most embodiments of the present invention, the cover of the trash receptacle can be swung open after it is in the device. As the handle or foot pedal is lowered, the compactor head or plate presses down into the trash container. The compactor head can be square, round or any other shape, and can be flat or slightly curved upwards with soft edges so that compaction of trash does not rip into any plastic bags that are being compacted. The plunger 6 rides on a sliding tubing delivery system 7.

It should be noted, that while the preferred embodiment for the present invention is as a manual unit, the unit can optionally be motorized and used as an electrical appliance.

Figure 9:
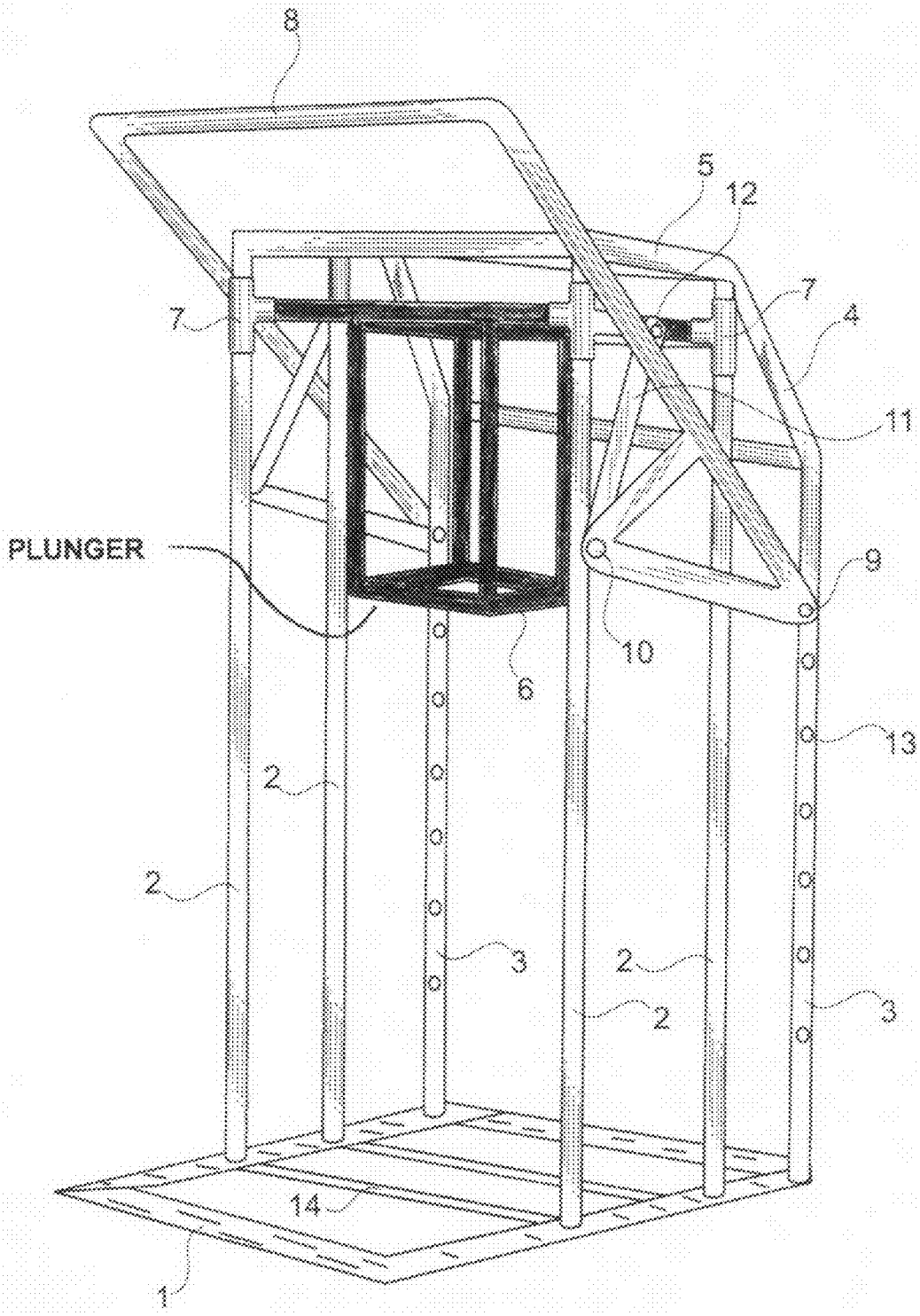
FIG. 9 shows the frame of the embodiment of FIG. 1 with the plunger or compressor head driver emphasized.
Figure 10:
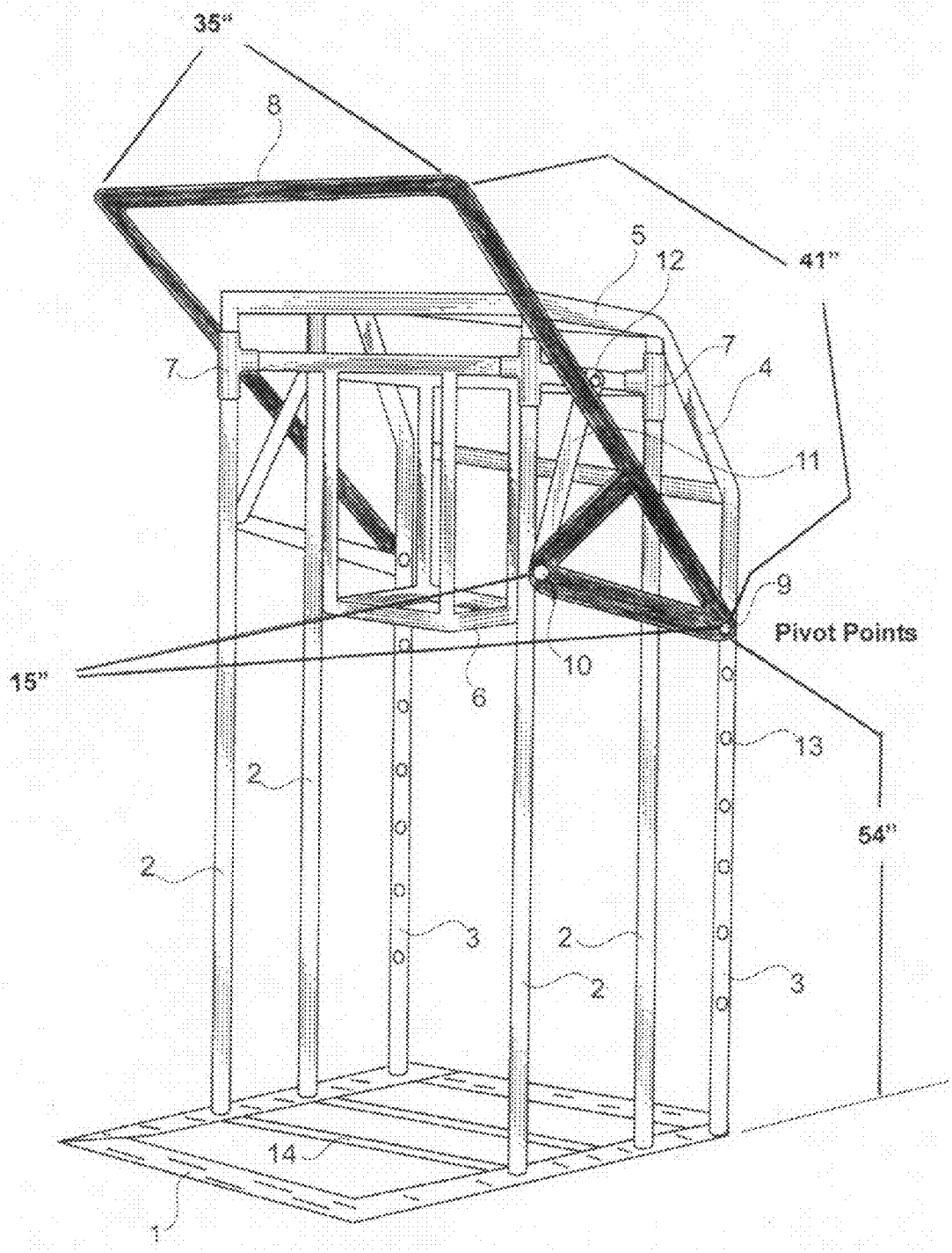
FIG. 10 shows the frame of the embodiment of FIG. 1 with the lever arm emphasized and with optional example dimensions.
Figure 11:
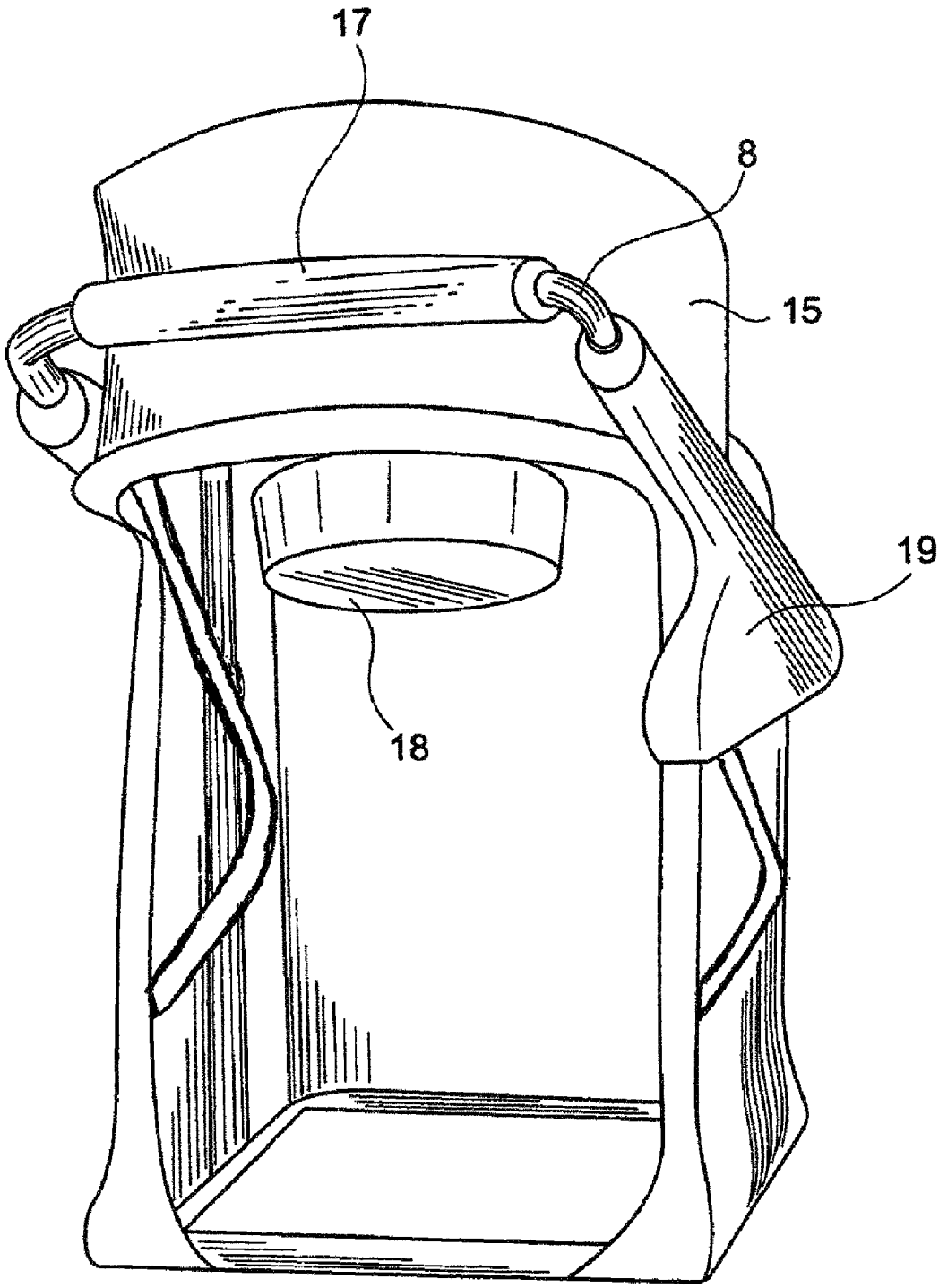
FIG. 11. shows the embodiment of FIG. 2 with a slot in the exterior cover.

FIG. 9 shows the frame embodiment of FIG. 1 with the plunger or compressor driver 6 emphasized. The sliding tubing delivery system can also be seen. FIG. 10 shows the frame embodiment of FIG. 1 with the drive handle and lever arm emphasized. FIG. 10 also contains example dimensions. It should be understood that these dimensions are being provided in FIG. 10 for the purposes of illustration of a typical size of the present invention. Any sizes or dimensions are within the scope of the present invention. In FIG. 10, it can be seen, that the example distance from the base of the frame to the highest setting of the adjustable pivot points 9 is around 54 inches. The length of the lower lever arm is around 15 inches. The length of the handle from the pivot points 9 to the front handle part 8 is around 41 inches, and the width of the handle part 8 is around 35 inches. As has been stated, any other reasonable dimensions can be used.

Several descriptions and illustrations have been provided to aid in understanding the present invention. One skilled in the art will realize that numerous changes and variations are possible without departing from the spirit of the invention. Each of these changes and variations is within the scope of the present invention.

I claim:

1. An adjustable universal trash compactor comprising:

a frame including a plurality of vertical slider support members;

a compactor driver slidlingly attached to said vertical slider members with a plurality of slider sleeves;

a compactor head attached to said compactor driver;

a handle mechanism coupled to said compactor driver applying force to said compactor driver and causing it to slide vertically along said vertical slider support members;

a vertical adjustment coupling said handle mechanism to said frame, wherein said handle mechanism can be adjustably raised and lowered along said vertical slider support members;

a utility cover over said frame;

wherein said frame can receive containers of different sizes or said compactor can be operated with no container;

and wherein said compactor head is configurable to be replaced with compactor heads of different sizes and shapes.

2. The universal trash compactor of claim 1 wherein said compactor driver can be adjusted from a first length to a second length.

3. The universal trash compactor of claim 1 further comprising at least two wheels attached to said frame.

4. The universal trash compactor of claim 1 wherein said compactor head is a polymer material.

5. The universal trash compactor of claim 1 wherein said compactor head is a solid piece.

6. The universal trash compactor of claim 1 wherein said vertical slider support members are a polymer material.

7. The universal trash compactor of claim 1 wherein said utility cover is a polymer material.

8. A universal manual trash compactor comprising:

a vertically sliding compactor member slidingly attached to a plurality of vertical slide bars, said compactor member also attached to a levered handle manipulatable to cause said compactor member to move vertically along said vertical slide bars;

an adjustment mechanism cooperating with said levered handle, wherein said levered handle can be adjusted vertically to fit different sized trash containers;

a base attached to a frame, said base and frame supporting said vertical slide bars and said levered handle, said base flat for receiving trash containers;

a utility cover over said frame;

and wherein said compactor member is configurable to be replaced with compactor members of different sizes and shapes.

9. The universal manual trash compactor of claim 8 wherein said compactor member can be adjusted longer or shorter for different compacting tasks.

10. The universal manual trash compactor of claim 9 wherein said compactor member includes a telescoping length adjustment mechanism.

11. The universal manual trash compactor of claim 8 further comprising an outside shell over said frame.

12. The universal manual trash compactor of claim 11 wherein said outside shell is made of polymer.

* * * * *